US006733326B2

(12) United States Patent
Lee

(10) Patent No.: US 6,733,326 B2
(45) Date of Patent: May 11, 2004

(54) FLEXIBLE PRINTED CIRCUIT CONNECTOR CAPABLE OF RESISTING AGAINST LATERAL PRESSURE

(75) Inventor: Ipson Lee, Taoyuan (TW)

(73) Assignee: Super Link Electronics Co., Ltd., Taoyuan (TW)

( * ) Notice: Subject to any disclaimer, the term of this patent is extended or adjusted under 35 U.S.C. 154(b) by 0 days.

(21) Appl. No.: 10/152,735

(22) Filed: May 23, 2002

(65) Prior Publication Data

US 2003/0220013 A1 Nov. 27, 2003

(51) Int. Cl.[7] ..... H01R 12/24
(52) U.S. Cl. ..... 439/495
(58) Field of Search ..... 439/495, 260, 439/67, 496, 77

(56) References Cited

U.S. PATENT DOCUMENTS 6,280,217 B1 * 8/2001 Lin ..... 439/260
6,533,606 B2 * 3/2003 Yamane ..... 439/495

* cited by examiner

*Primary Examiner*—Javaid H. Nasri
(74) *Attorney, Agent, or Firm*—Rosenberg, Klein & Lee

(57) ABSTRACT

A flexible printed circuit connector capable of resisting against lateral pressure, includes an insulating base seat in which multiple terminals are inlaid. Each of two sides of the insulating base seat being formed with an insertion hole. Two pivot members, first ends of the pivot members being respectively inserted in two sides of the insulating base seat, each pivot member being formed with a stop plate near a second end thereof, in normal state, the stop plate abutting against a lateral side of the insulating base seat. A pressing cover board pivotally connected with the pivot members for correspondingly covering the insulating base seat and tightly pressing a flexible printed circuit to electrically connect with the terminals of the insulating base seat. The stop plate abuts against the lateral side of insulating base seat to resist against lateral external force and prevent the pivot member from being deformed.

3 Claims, 4 Drawing Sheets

FLEXIBLE PRINTED CIRCUIT CONNECTOR CAPABLE OF RESISTING AGAINST LATERAL PRESSURE

BACKGROUND OF THE INVENTION

1. Field of the Invention

The present invention is related to a flexible printed circuit connector capable of resisting against lateral pressure, and more particularly to a flexible printed circuit connector in which the pivot members on two sides of the connector are prevented from being deformed and damaged by external force.

2. Description of the Prior Art

The flexible printed circuit (F.P.C.) is mainly used in a bendable electronic product such as a notebook-type computer and an electronic dictionary. The flexible printed circuit must be light and thin for easy carriage. The connector for connecting with the flexible printed circuit is also required to have light weight and thin thickness. Several such flexible printed circuit connector are cited in U.S. Pat. No. 6,345,998, issued Feb. 12, 2002 which is incorporated herein by reference.

U.S. Pat. No. 6,345,998 showing my invention which discloses a flexible printed circuit connector. The flexible printed circuit connector includes: an insulating base seat having a longitudinally extending seat body, each end of the insulating base seat being formed with an insertion hole; multiple conductive terminals inlaid in the insulating base seat for electrically connecting with the flexible printed circuit; two metallic pivot members respectively inserted in two ends of the insulating base seat; and a metallic cover board two ends of which are pivotally connected with the metallic pivot members inserted in two ends of the insulating base seat.

The above connector has a shortcoming as follows: One end of each metallic pivot member is formed with an insertion section snugly inserted in the insertion hole of the insulating base seat. The other end of the pivot member is a free end spaced from the insulating base seat by a certain distance. When a user mounts the connector or the flexible printed circuit, the user's finger may incautiously press and deform the free end. As a result, it will be impossible to open or close the cover board.

SUMMARY OF THE INVENTION

It is therefore a primary object of the present invention to provide a flexible printed circuit connector capable of resisting against lateral pressure, including: an insulating base seat in which multiple terminals are inlaid, each of two sides of the insulating base seat being formed with an insertion hole; two pivot members, first ends of the pivot members being respectively inserted in two sides of the insulating base seat, each pivot member being formed with a stop plate near a second end thereof, in normal state, the stop plate abutting against a lateral side of the insulating base seat; and a pressing cover board pivotally connected with the pivot members for correspondingly covering the insulating base seat and tightly pressing a flexible printed circuit to electrically connect with the terminals of the insulating base seat. The stop plate abuts against the lateral side of insulating base seat to resist against lateral external force and prevent the pivot member from being deformed. Accordingly, the quality of the connector can be ensured.

The present invention can be best understood through the following description and accompanying drawings wherein:

DETAILED DESCRIPTION OF THE PREFERRED EMBODIMENTS

Please refer to FIGS. 1 to 5. According to the present invention, the flexible printed circuit connector capable of resisting against lateral pressure includes an insulating base seat 11; two pivot members respectively inserted in two sides of the insulating base seat 11; and a pressing cover board 13 two sides of which are pivotally connected with the pivot members 12 for covering the insulating base seat 11.

Figure 1:
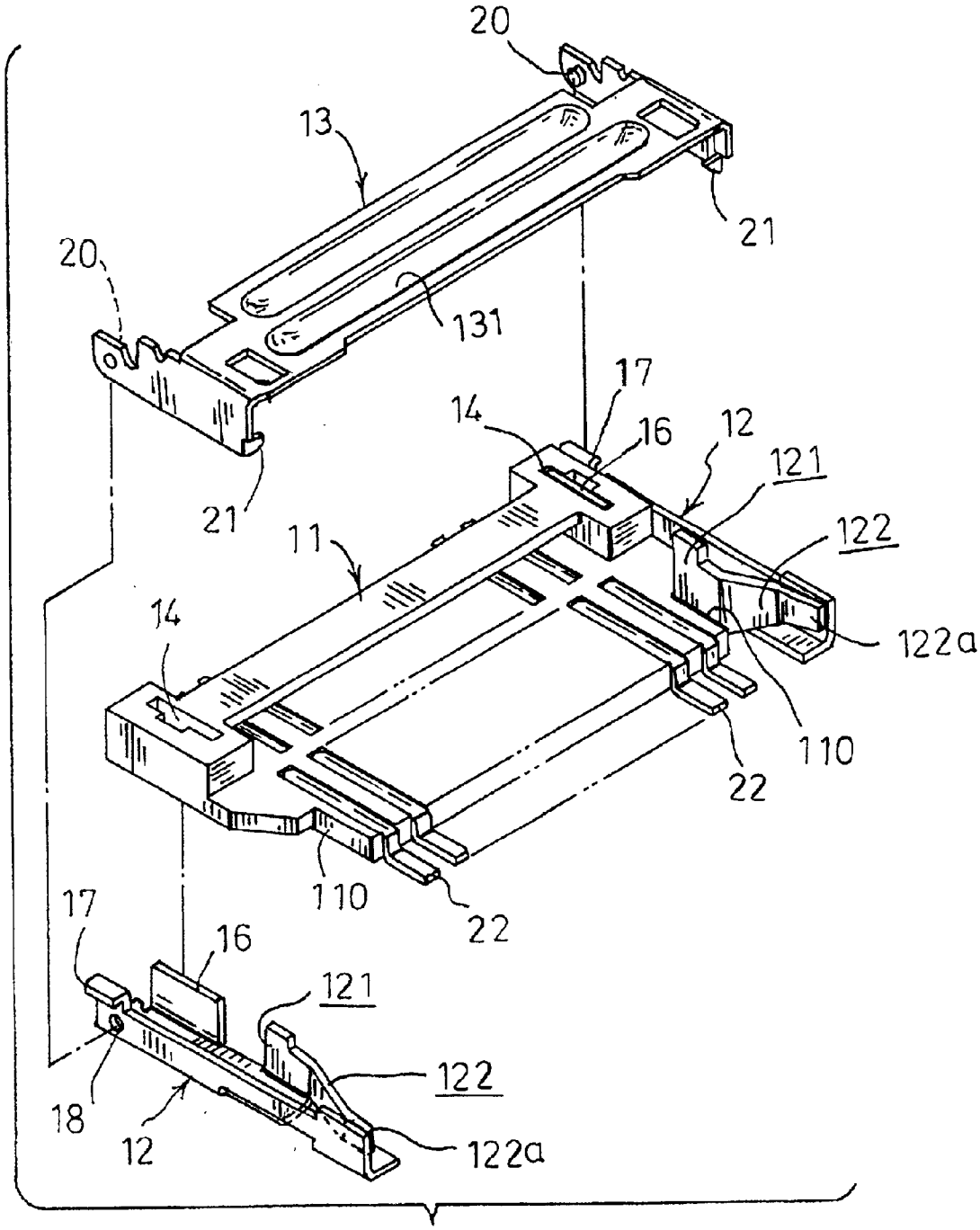
FIG. 1 is a perspective exploded view of the present invention.
Figure 2:
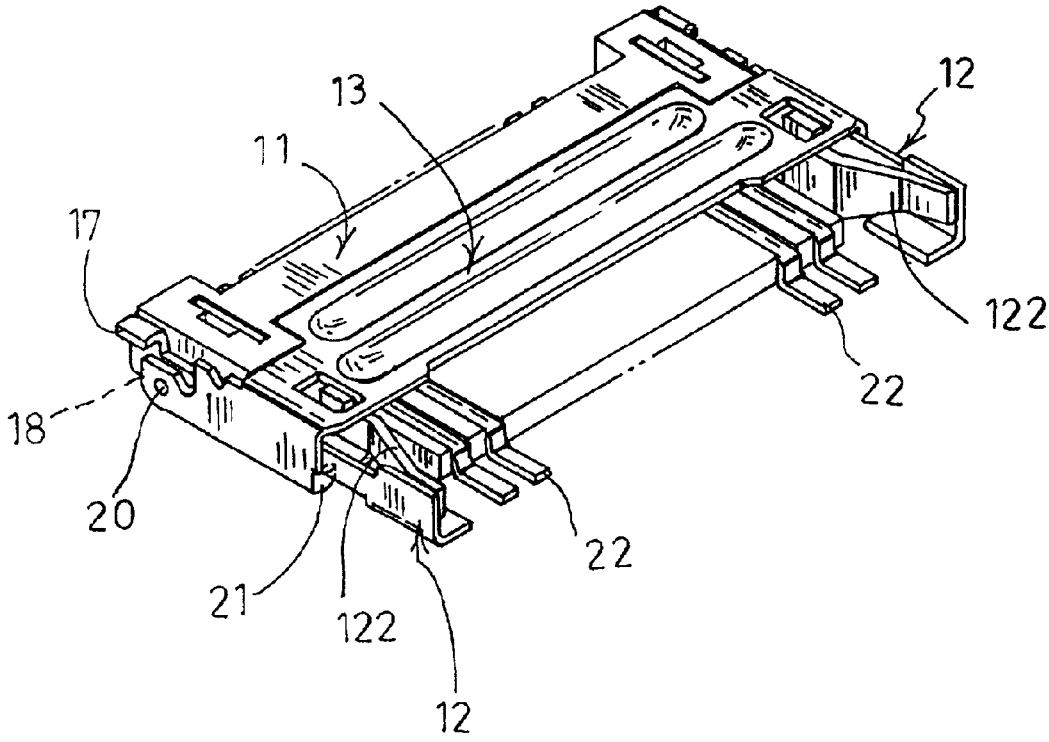
FIG. 2 is a perspective assembled view of the present invention.

Referring to FIG. 1, each of two sides of the insulating base seat 11 is formed with at least one insertion hole 14. Multiple conductive terminals 22 are inlaid in the insulating base seat 11 for electrically connecting with the flexible circuit board 15.

The pivot member 12 is integrally made of one single metallic material by punching. A first end of the pivot member 12 is formed with at least one insertion section 16 which is snugly inserted in the insertion hole 14 of the insulating base seat 11 for fig the pivot member 12 thereon. The pivot member 12 is further formed with a stop plate 121 near a second end of the pivot member 12. In normal state, the stop plate 121 abuts against a lateral wall 110 of the insulating base seat 11. A resilient plate 122 extends from the stop plate 121. In normal state, a free end 122*a* of the resilient plate 122 abuts against the second end of the pivot member 12 to prevent the second end from being bent and deformed by external force.

An outer wall of the pivot member 12 is formed with a pivot hole near the first end to form a first pivot section 18 for pivotally connecting with the pressing cover board 13.

Figure 3:
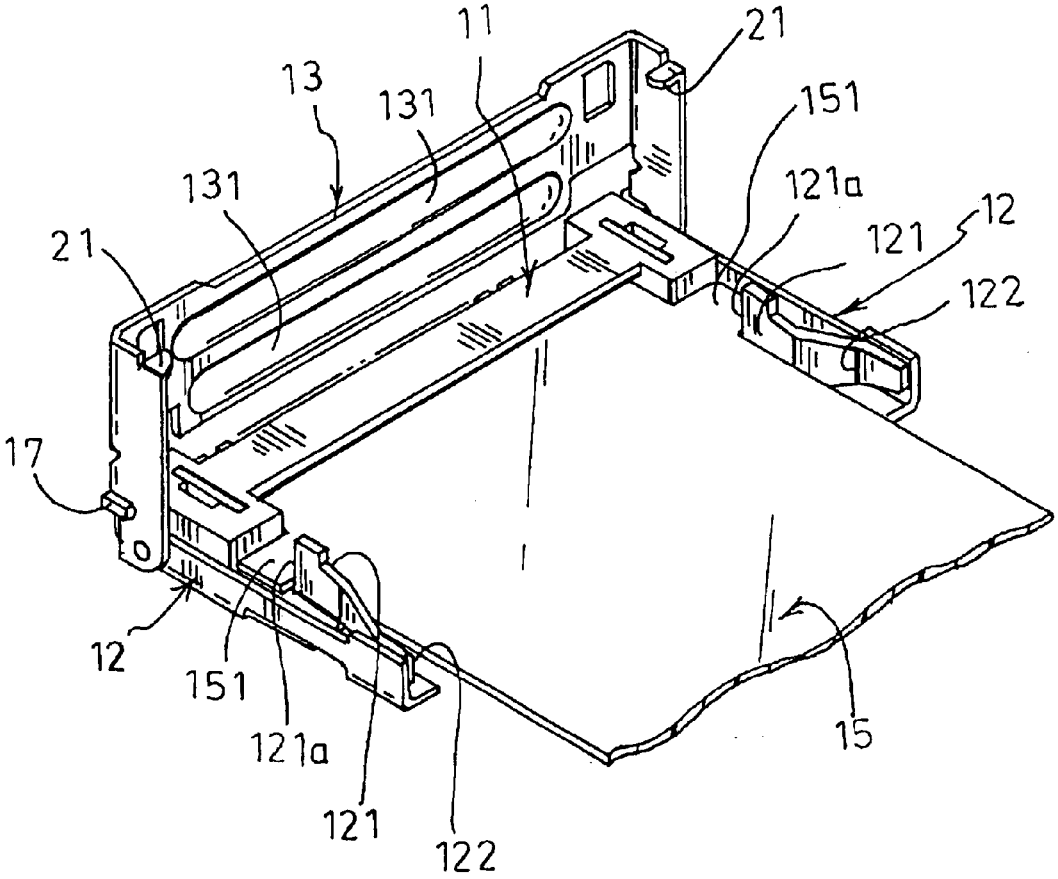
FIG. 3 is a perspective view showing that the pressing cover board of the present invention is pivoted up.
Figure 4:
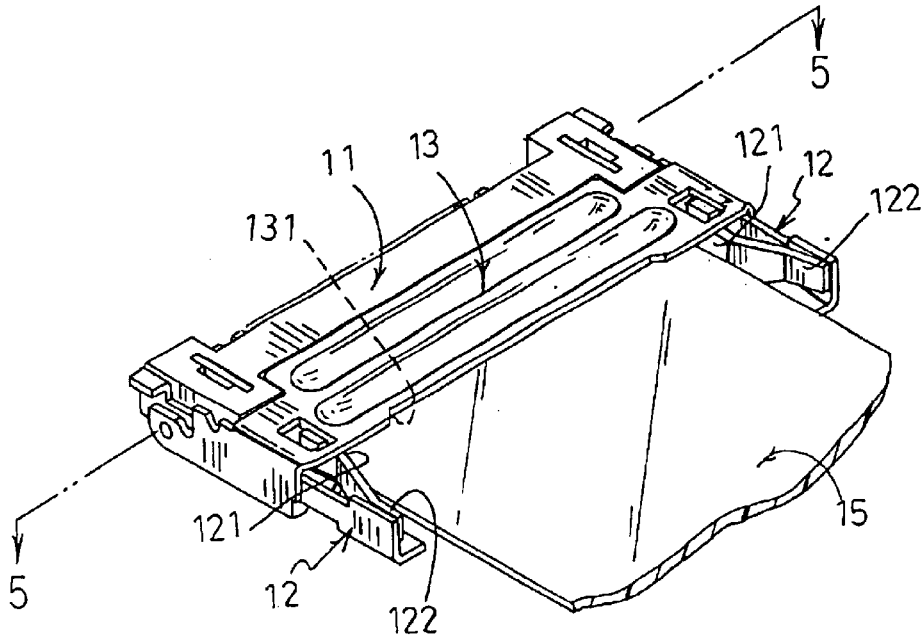
FIG. 4 is a perspective view according to FIG. 3, showing that the pressing cover board of the present invention is closed.
Figure 5:
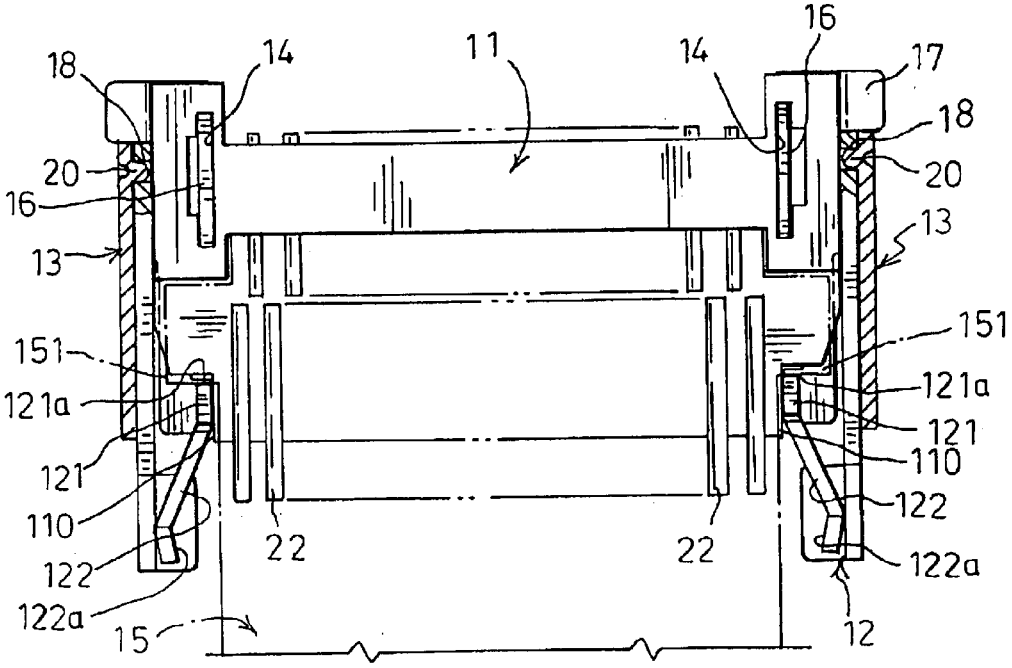
FIG. 5 is a sectional view taken along line 5—5 of FIG. 4.

Referring to FIGS. 3 and 5, when the flexible printed circuit 15 is placed into the connector, the front edge 121*a* of the stop plate 121 of the pivot member 12 abuts against a rear edge of a projecting plate 151 of the flexible printed circuit so as to prevent the flexible printed circuit 15 from being drawn out by external force.

The pivot member 12 is formed with a stop section 17 near the first end. The stop section 17 outward extends from a portion adjacent to the first pivot section 18 for stopping the upward pivoted pressing cover board 13, whereby after upward pivoted, the pressing cover board 13 is leant on the stop section 17.

Each of two ends of the pressing cover board 13 is respectively formed with a second pivot section 20 and a latch section 21. The second pivot section 20 is pivotally connected with the first pivot section 18 of the pivot member 12 inserted in the end of the insulating base seat 11. Therefore, the pressing cover board 13 can be pivoted relative to the pivot member 12 and the insulating base seat 11. When the pressing cover board 13 is pivoted toward the metallic pivot members 12 and the insulating base seat 11 and closed, the latch sections 21 of two ends of the pressing cover board 13 are latched with the bottom edge of the pivot members 12.

Two sides of the pressing cover board 13 are respectively formed with two pivot pins to form the second pivot sections 20. However, the second pivot sections 20 and the first pivot sections 18 of the pivot members 12 are not limited to fixed pattern. Other pivot measure can be also used in the present invention.

The pressing cover board 13 is further formed with at least one longitudinal pressing rib 131 which protrudes inward. Accordingly, when the pressing cover board 13 is closed and latched with the insulating base seat 11, the pressing rib 131 can press the flexible printed circuit 15, making the flexible printed circuit 15 firmly electrically connect with the conductive terminals.

The stop plate 121 and resilient plate 122 of the pivot member 12 integrally extend from a portion near the second end of the pivot member 12. In normal state, the stop plate 122 and the resilient plate 122 respectively abut against the insulating base seat 11 and the pivot member 12. Accordingly, when two sides of the connector suffer external force, the pivot members 12 are prevented from being deformed and damaged.

The above embodiments are only used to illustrate the present invention, not intended to limit the scope thereof. Many modifications of the above embodiments can be made without departing from the spirit of the present invention.

What is claimed is:

1. A flexible printed circuit connector capable of resisting against lateral pressure, comprising:

(a) an insulating base seat having a plurality of terminals disposed thereon;

(b) two pivot members, first ends of the pivot members being respectively inserted in two sides of the insulating base seat, each pivot member being further formed with a stop plate near a second end of the pivot member, the stop plate abutting against a lateral wall of the insulating base seat; and, (c) a pressing cover board pivotally connected with the pivot members for correspondingly covering the insulating base seat and tightly pressing a flexible printed circuit to electrically connect with the terminals of the insulating base seat, an outer wall of each pivot member being formed with a pivot hole near the first end thereof to form a first pivot section for pivotally connecting with the pressing cover board, each pivot member being further formed with an outward extending stop section near the first end thereof, the stop section serving to limit an upward pivoting of the pressing cover board, whereby upward pivoting of the pressing cover board is stopped by the pressing cover board making contact with the stop section.

2. A flexible printed circuit connector capable of resisting against lateral pressure, comprising:

(a) an insulating base seat having a plurality of terminals disposed thereon:

(b) two pivot members, first ends of the pivot members being respectively inserted in two sides of the insulating base seat, each of the pivot members is integrally made of one single metallic material, the first end of the each pivot member being formed with at least one insertion section which is snugly inserted in an insertion hole of one side of the insulating base seat, each pivot member being further formed with a stop plate near a second end of the pivot member, the stop plate abutting against a lateral wall of the insulating base seat, a resilient plate extending from the stop plate, a free end of the resilient plate abutting against the second end of the pivot; and, (c) a pressing cover board pivotally connected with the pivot members for correspondingly covering the insulating base seat and tightly pressing a flexible printed circuit to electrically connect with the terminals of the insulating base seat.

3. A flexible printed circuit connector capable of resisting against lateral pressure, comprising:

(a) an insulating base seat having a plurality of terminals disposed thereon:

(b) two pivot members, first ends of the pivot members being respectively inserted in two sides of the insulating base seat, each pivot member being further formed with a stop plate near a second end of the pivot member the stop late abutting against a lateral wall of the insulating base seat; and, (c) a pressing cover board pivotally connected with the pivot members for correspondingly covering the insulating base seat and tightly pressing a flexible printed circuit to electrically connect with the terminals of the insulating base seat;

wherein when the flexible printed circuit is placed into the connector, a front edge of the stop plate of each pivot member abuts against a rear edge of a corresponding projecting plate of the flexible printed circuit to prevent the flexible printed circuit board from being drawn out by an external force.

* * * * *